US008408734B2

(12) United States Patent
Wu et al.

(10) Patent No.: US 8,408,734 B2
(45) Date of Patent: Apr. 2, 2013

(54) STRUCTURE OF LIGHTING DEVICE

(75) Inventors: Chih-Hsien Wu, San Chung (TW); Meng-Chieh Chou, San Chung (TW); Chung-Yu Wang, San Chung (TW)

(73) Assignee: Unity Opto Technology Co., Ltd. (TW)

( * ) Notice: Subject to any disclaimer, the term of this patent is extended or adjusted under 35 U.S.C. 154(b) by 296 days.

(21) Appl. No.: 12/801,703

(22) Filed: Jun. 22, 2010

(65) Prior Publication Data

US 2011/0292646 A1 Dec. 1, 2011

(30) Foreign Application Priority Data

May 25, 2010 (TW) ..... 99209827 U

(51) Int. Cl.
*F21V 7/20* (2006.01)
*F21V 29/00* (2006.01)

(52) U.S. Cl. ... 362/218; 362/221; 362/230; 362/249.02; 362/311.02

(58) Field of Classification Search ..... 362/218, 362/221, 222, 227, 230, 231, 249.02, 260, 362/311.02
See application file for complete search history.

(56) References Cited

U.S. PATENT DOCUMENTS 5,479,327 A * 12/1995 Chen ..... 362/222
6,561,690 B2 * 5/2003 Balestriero et al. ..... 362/555
7,654,703 B2 * 2/2010 Kan et al. ..... 362/362
7,815,338 B2 * 10/2010 Siemiet et al. ..... 362/218
7,926,985 B2 * 4/2011 Teng et al. ..... 362/373
8,167,466 B2 * 5/2012 Liu ..... 362/373
2009/0323341 A1 * 12/2009 Chui ..... 362/249.02

* cited by examiner

*Primary Examiner* — Evan Dzierzynski
*Assistant Examiner* — Danielle Allen
(74) *Attorney, Agent, or Firm* — Bacon & Thomas, PLLC

(57) ABSTRACT

A structure of lighting device includes a hood, a heat dissipater, at least one substrate board, and a fastener. The hood forms a receiving space, at least one fitting slot, and at least one heat dissipation opening. The fitting slot is located inside the receiving space. The heat dissipation opening is defined in a circumferential surface of the hood. The heat dissipater is received in the receiving space. The heat dissipater forms at least one guide section. The guide section opposes the fitting slot and is received in the fitting slot. The substrate board is electrically connected to at least one light-emitting diode. The substrate board is coupled to the heat dissipater. The heat dissipation opening allows for air circulation for removing heat generated by light-emitting diodes. Further, the heat dissipation opening is formed to have a width W less than 3 mm, and the heat dissipater is arranged to be spaced from a circumferential surface of the hood by a distance greater than 6 mm.

12 Claims, 4 Drawing Sheets

STRUCTURE OF LIGHTING DEVICE

FIELD OF THE INVENTION

The present invention relates to a structure of lighting device, and in particular to a structure of lighting device applicable to light-emitting diode (LED).

BACKGROUND OF THE INVENTION

A lighting device is commonly used to improve a space of dim light or a location where light is shielded for ensuring sufficiency of lighting and protecting eyes against poor eyesight or eye diseases, such as myopia, caused by long term insufficiency of lighting. Further, the trend of energy saving and carbon reduction and the invention of light-emitting diodes (LEDs) cause the traditional light sources of tungsten filament bulbs, which consume a large amount of power, to be gradually replaced by LEDs, which are of a small size and consume a minor amount of power.

A conventional lighting device is often composed of a circuit board, a base, and a hood. The circuit board carries a plurality of LEDs mounted thereon and is fixed on the base. The base and the hood are coupled to each other. The circuit board comprises a circuit that controls the operation of the light-emitting elements to give off light. However, the base must be pre-machined through tapping operation to form inner-threaded holes therein. The circuit board is then fixed to the base by being secured by bolts that are tightened to the inner-threaded holes one by one. This operation is troublesome. Further, the bolts are tightened in a one-by-one manner and a large number of bolts are used in securely fixing the circuit board. This often leads to unbalance distribution of tightening force and warp and deformation of the circuit board.

Further, since the operation of multiple LEDs generates a great amount of heat, the conventional lighting device is often provided with a heat dissipater on the circuit board to remove the heat generated by the multiple LEDs. However, the conventional heat dissipater is made of aluminum extrusion and is not enclosed in a lighting tube, so that a user is often subjected to electrical shock due to unexpected touch with the heat dissipater in replacing a lighting tube, leading to hazards. Thus, the present invention aims to provide a structure of lighting device that improves the convenience of use of lighting device.

SUMMARY OF THE INVENTION

An objective of the present invention is to provide a structure of lighting device, which uses a hood made of a non-conductive material to completely enclose a heat dissipater made of aluminum therein to provide an effect of preventing electrical shock caused by inadvertent contact with the heat dissipater in replacing a lighting tube.

Another objective of the present invention is to provide a structure of lighting device, which comprises a hood that forms at least one fitting slot to allow a heat dissipater to be coupled to and/or removed from the hood in a slidably replacing manner for realizing effects of efficient replacement of the heat dissipater and lowering of costs.

A further objective of the present invention is to provide a structure of lighting device, which comprises a heat dissipater that defines a recess and a substrate board that forms a mounting hole corresponding to the recess so that an effect of preventing warp of the substrate board caused by tightening a bolt is realized.

A further objective of the present invention is to provide a structure of lighting device, which comprises a hood that forms at least one heat dissipation opening that allows for air circulation for removing heat generated by light-emitting diodes so as to realize the effects of expanding service life of light-emitting diodes and reducing the damage of the lighting device.

Yet a further objective of the present invention is to provide a structure of lighting device, which comprises a hood that forms at least one heat dissipation opening having a width W less than 3 mm, and a heat dissipater is arranged to be spaced from a circumferential surface of the hood by a distance greater than 6 mm so as to ensure compliancy of safety regulations.

To achieve the above objectives, the present invention provides a lighting device comprising a hood, a heat dissipater, at least one substrate board, and a fastener. The hood forms a receiving space, at least one fitting slot, and at least one heat dissipation opening. The fitting slot is located inside the receiving space. The heat dissipation opening is defined in a circumferential surface of the hood. The heat dissipater is received in the receiving space. The heat dissipater forms at least one guide section, a guide slot, and a recess. The guide section opposes the fitting slot and is received in the fitting slot. The substrate board is electrically connected to at least one light-emitting diode. The substrate board is received in the guide slot and forms a mounting hole corresponding to the recess. The fastener is received through the mounting hole to engage the recess, so as to couple the substrate board to the heat dissipater.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1A:
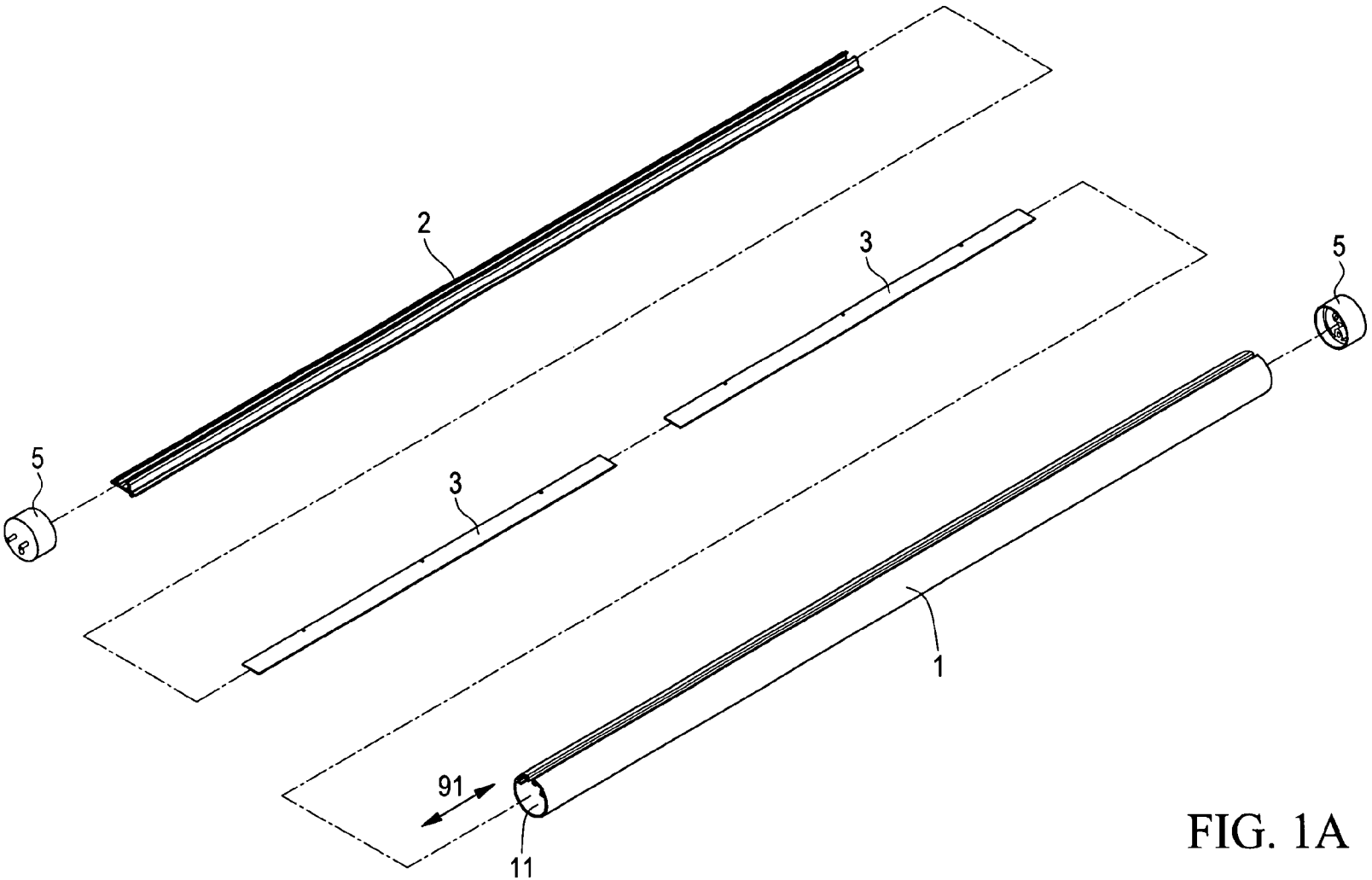
FIG. 1A is an exploded view of a lighting device constructed in accordance with a preferred embodiment of the present invention.
Figure 1B:
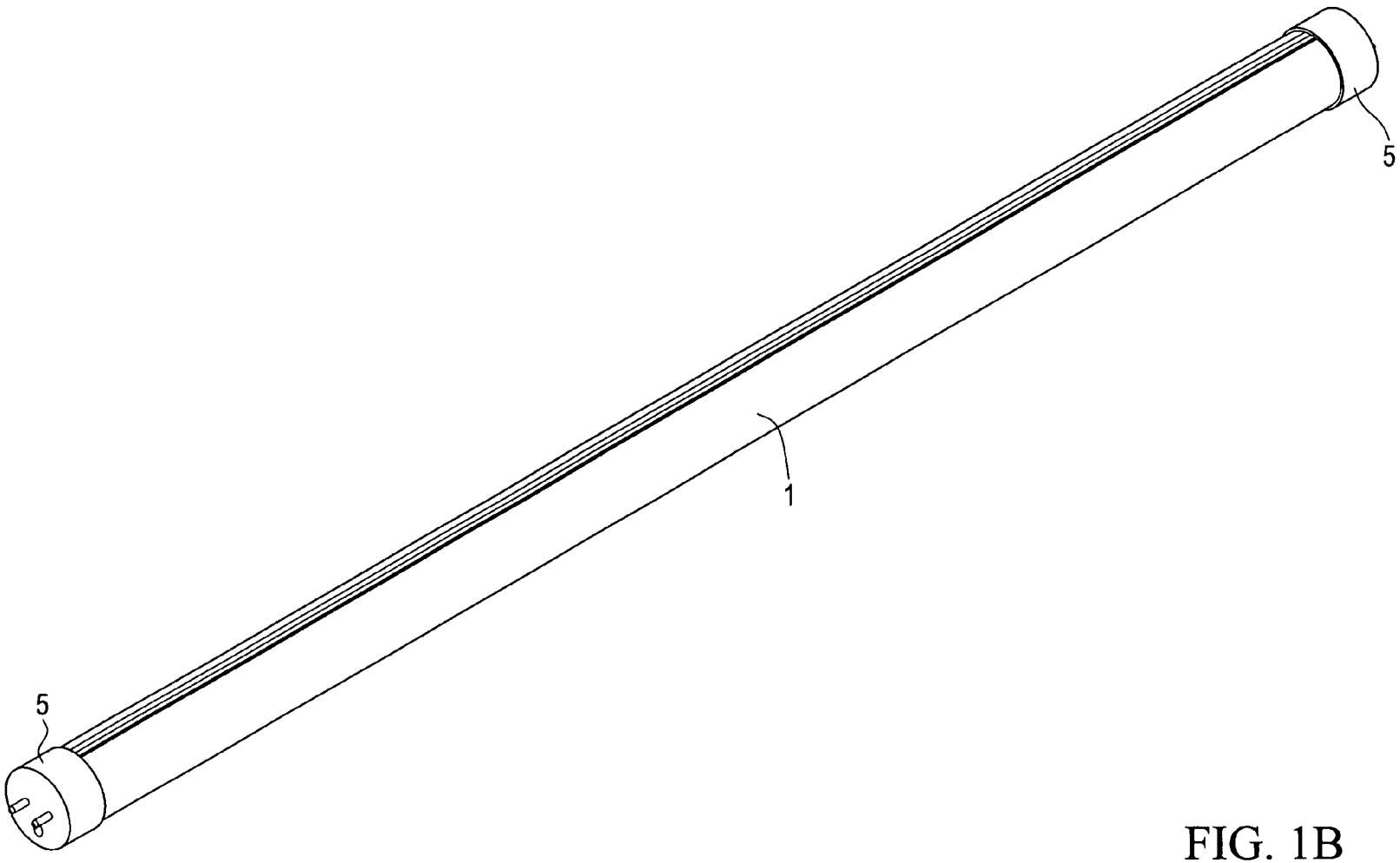
FIG. 1B is a perspective view of the lighting device constructed in accordance with the preferred embodiment of the present invention.
Figure 1C:
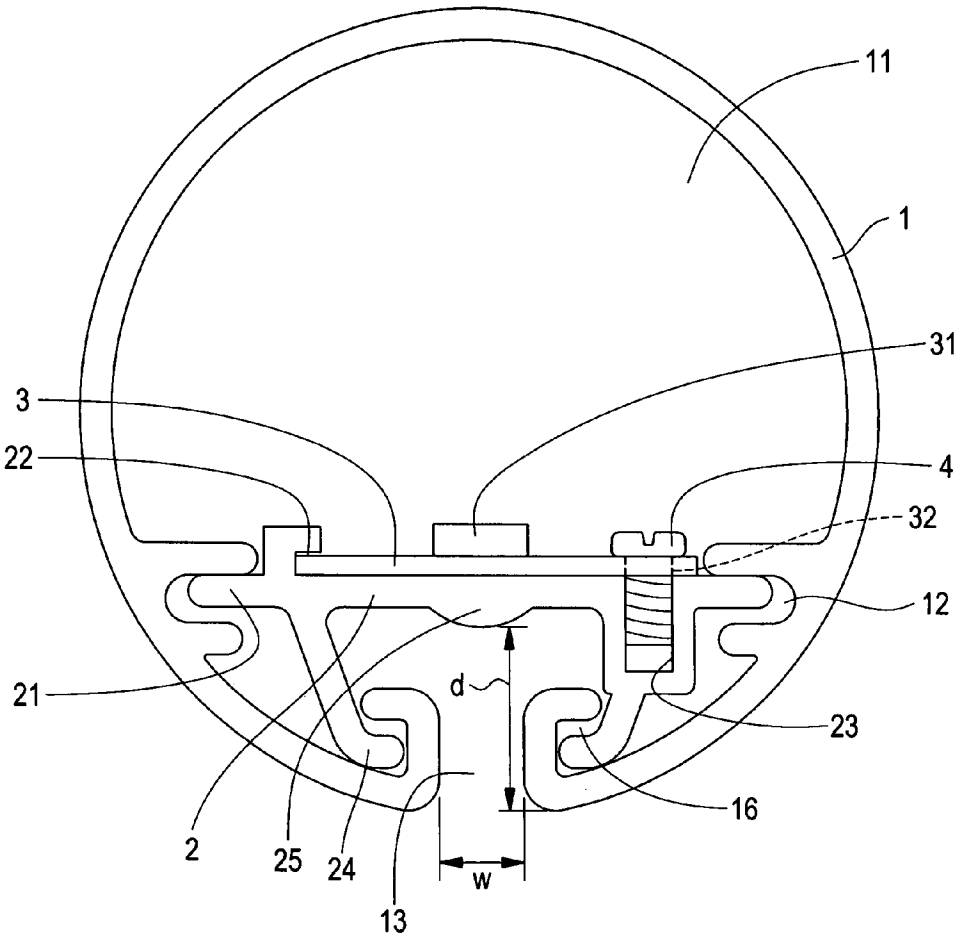
FIG. 1C is a cross-sectional view of the lighting device constructed in accordance with the preferred embodiment of the present invention.

With reference to the drawings and in particular to FIGS. 1A-1C, which show an exploded view, a perspective view, and a cross-sectional view of a lighting device constructed in accordance with a preferred embodiment of the present invention, the lighting device of the present invention comprises a hood 1, a heat dissipater 2, at least one substrate board 3, and a fastener 4. The hood 1 forms a receiving space 11, at least one fitting slot 12, and at least one heat dissipation opening 13. The fitting slot 12 is located inside the receiving space 11. In the preferred embodiment, for easy assembling and mounting the heat dissipater 2 to the hood 1, two fitting slots 12 are provided, respectively on two opposite sides of the receiving space 11. The heat dissipation opening 13 is defined in a circumferential surface of the hood 1 and the heat dissipation opening 13 extends substantially in an axial direction 91 of the hood 1 to be in communication with two end openings 14, 15 of the hood 1. With such an arrangement, the heat dissipation opening 13 can be directly formed at the time when the hood 1 is manufactured or simply by a single operation of stamping. To prevent a user from inadvertently contacting the heat dissipater 2 and thus being electrically shocked in replacing the lighting device, the heat dissipation opening 13 is made having a width W, which has a size less than 3 mm.

The heat dissipater 2 is formed of aluminum extrusion. The heat dissipater 2 is put into the receiving space 11 along the axial direction 91. The heat dissipater 2 comprises at least one guide section 21, a guide slot 22, and a recess 23. The guide section 21 is arranged to oppose the fitting slots 12 and two guide sections 21 are provided in the instant embodiment, whereby the guide sections 21 are respectively receivable in the fitting slots 12 for linear movement in the axial direction 91. To securely mount the heat dissipater 2 to the hood 1, the hood 1 forms at least one retention slot 16, which is opposite to the heat dissipation opening 13, and the heat dissipater 2 forms at least one side arm 24, which corresponds to the retention slot 16. The side arm 24 has a distal end received in the retention slot 16.

The heat dissipater 2 has one side portion forming the guide slot 22 and an opposite side portion forming the recess 23. The substrate board 3 has an edge fit into the guide slot 22. The substrate board 3 has a surface electrically connecting at least one light-emitting diode (LED) 31. The substrate board 3 has an opposite edge forming at least one mounting hole 32 corresponding to the recess 23. The fastener 4 (such as a bolt) has a diameter greater than width of the recess 23 of the heat dissipater 2, whereby the fastener 4 is received through the mounting hole 32 and tightly engages in the recess 23 to fix the substrate board 3 to the heat dissipater 2, so that the heat dissipater 2 may dissipate heat generated by the operation of the substrate board 3 to the surroundings.

In the preferred embodiment, to make the heat dissipater 2 more effectively dissipate the heat generated by the substrate board 3 to the surroundings, the heat dissipater 2 further forms a protrusion 25, which opposes the heat dissipation opening 13 and is spaced from a circumferential surface of the hood 1 by a distance d, which is greater than 6 mm. The distance d of such a length, when cooperating with the heat dissipation opening 13 has a width W less than 3 mm ensuring the compliancy of safety regulation.

In the preferred embodiment, the fastener 4 is a bolt and the substrate board 3 is a circuit board that carries a plurality of LEDs 31. To mount the substrate board 3, an edge of the substrate board 3 is first fit into the guide slot 22 of the heat dissipater 2 to have the edge of the substrate board 3 retained in the guide slot 22. Since an opposite edge of the substrate board 3 defines at least one mounting hole 32 corresponding to the recess 23 of the heat dissipater 2, by fitting the fastener 4 through the mounting hole 32 to directly and tightly engage in the recess 23, the substrate board 3 can be easily mounted to the heat dissipater 2. The structural arrangement is simple and no pre-machining of tapping inner-threaded hole is needed in tightening the fastener 4 in the recess 23, so that advantages of efficient manufacturing, reduced consumption of labor and material, and lowering of manufacturing costs can be realized.

Further, the substrate board 3 is directly mounted to the heat dissipater 2 by having an edge thereof fit into the guide slot 22 and using the fastener 4 that is received through the mounting hole 32 defined in an opposite edge of the substrate board 3 to tightly engage the recess 23 of the heat dissipater 2, whereby warp of the substrate board 3 having a great length caused by fastening a number of bolts to secure the long substrate board 3 can be eliminated and further, the distance between adjacent fasteners 4 can be shortened to ensure better compliancy of the substrate board to the heat dissipater. In the preferred embodiment, the lighting device further comprises two caps 5, which are respectively mounted to opposite ends of the combined structure of the heat dissipater 2 and the hood 3.

Figure 2:
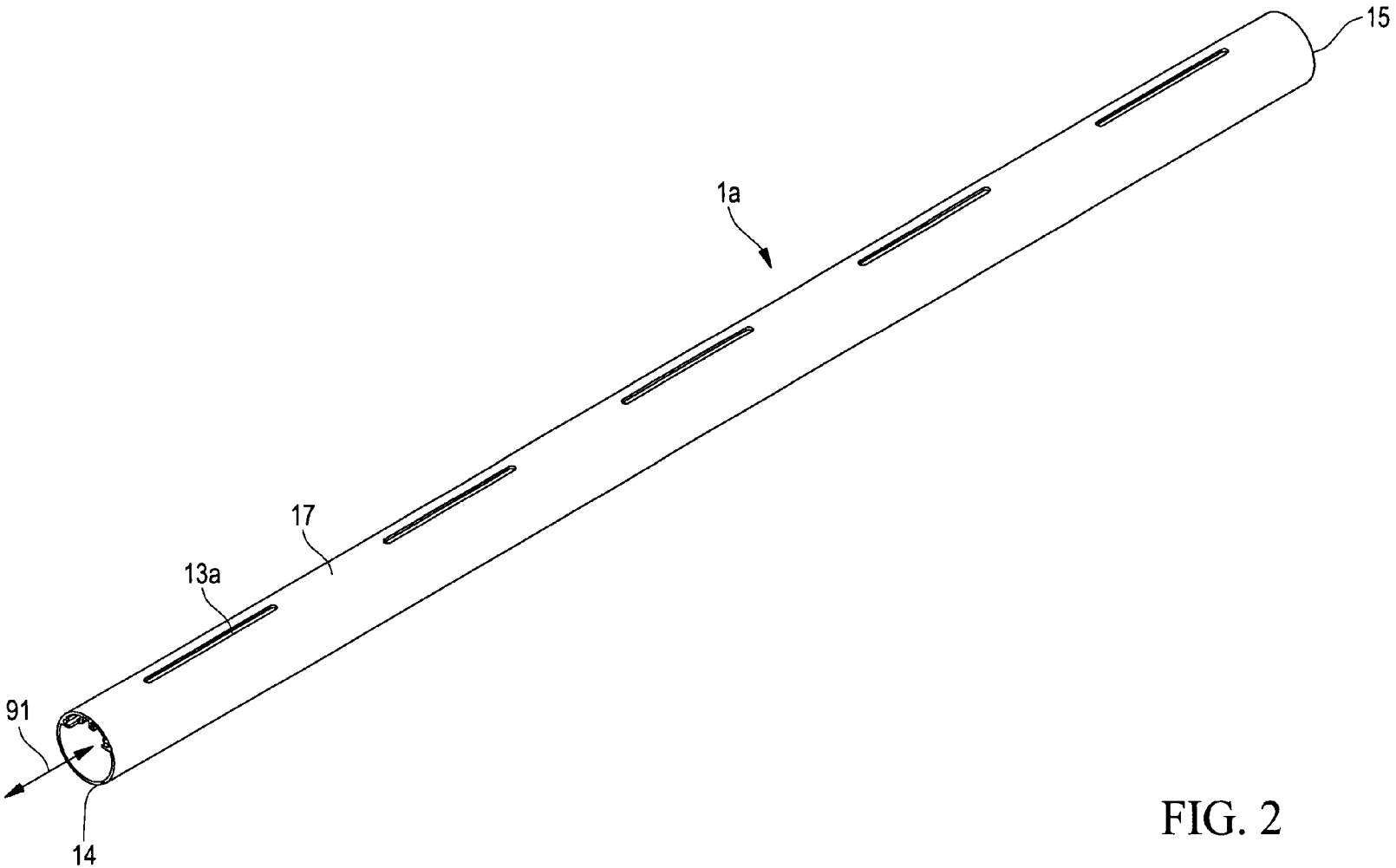
FIG. 2 a perspective view showing a second embodiment of a hood according to the present invention.

Referring to FIG. 2, which is a perspective view showing a second embodiment of the hood according to the present invention, in this embodiment, most of the components that comprise the hood 1 are similar or the same as their counterparts of the previous embodiment, these components are designate with the same reference numerals with a postfix "a" for distinction and description thereof is omitted. In this embodiment, a plurality of heat dissipation openings 13*a* is defined in an outer surface of the hood 1*a* in a properly arranged manner. Thus, after the hood 1*a* is formed, a secondary stamping operation is carried out on the hood 1*a* to form the plurality of heat dissipation openings 13*a* in the circumferential surface of the hood 1*a*. Thus, the hood further comprises at least one stop portion 17, which is formed on the circumferential surface of the hood 1*a* and each of the heat dissipation openings 13*a* extends substantially in the axial direction 91 of the hood 1*a* and the stop portions 17 are arranged to be respectively next to the heat dissipation openings 13*a*.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A lighting device, comprising:

a hood, which forms a receiving space, at least one fitting slot, and at least one heat dissipation opening, the fitting slot being located inside the receiving space, the heat dissipation opening being defined in a circumferential surface of the hood;

a heat dissipater, which is received in the receiving space, the heat dissipater comprising at least one guide section that is arranged to oppose the fitting slot so as to be received in the fitting slot; and at least one substrate board, which is electrically connected to at least one light-emitting diode, the substrate board being coupled to the heat dissipater.

2. The lighting device as claimed in claim 1, wherein the heat dissipation opening has width, which is less than 3 mm.

3. The lighting device as claimed in claim 1, wherein the heat dissipater forms a protrusion, which opposes the heat dissipation opening.

4. The lighting device as claimed in claim 3, wherein the protrusion is spaced from the circumferential surface of the hood by a distance that is greater than 6 mm.

5. The lighting device as claimed in claim 1, wherein the heat dissipation opening extends substantially in an axial direction of the hood and communicates end openings of the hood.

6. The lighting device as claimed in claim 1, wherein the hood comprises at least one stop portion, which is formed on the circumferential surface of the hood and is located next to the heat dissipation opening.

7. The lighting device as claimed in claim 1, wherein, the hood forms at least one retention slot, which is opposite to the heat dissipation opening.

8. The lighting device as claimed in claim 7, wherein the heat dissipater forms at least one side arm, which correspond to the retention slot, the side arm having a distal end received in the retention slot.

9. The lighting device as claimed in claim 1 further comprising two caps, which are respectively mounted to opposite ends of a combined structure of the heat dissipater and the hood.

10. The lighting device as claimed in claim 1, wherein the heat dissipater comprises a guide slot and a recess, the substrate board being received in the guide slot.

11. The lighting device as claimed in claim 10, wherein the substrate board forms a mounting hole corresponding to the recess, a fastener being received through the mounting hold to engage the recess for coupling the substrate board to the heat dissipater.

12. A lighting device, comprising:

a hood, which forms a receiving space, at least one fitting slot, and at least one heat dissipation opening, the fitting slot being located inside the receiving space, the heat dissipation opening being defined in a circumferential surface of the hood;

a heat dissipater, which is received in the receiving space, the heat dissipater comprising at least one guide section that is arranged to oppose the fitting slot so as to be received in the fitting slot; and at least one substrate board, which is electrically connected to at least one light-emitting diode, the substrate board being coupled to the heat dissipater, and wherein the heat dissipater includes a protrusion, which opposes the heat dissipation opening and is spaced from the circumferential surface of the hood by a distance that is greater than 6 mm;

the hood forms at least one retention slot, which is opposite to the heat dissipation opening; and wherein the heat dissipater forms at least one side arm, which correspond to the retention slot, the side arm having a distal end received in the retention slot.

* * * * *